US005337495A

United States Patent [19]

Pippins

[11] Patent Number: 5,337,495

[45] Date of Patent: Aug. 16, 1994

[54] TOOTH ASSEMBLY FOR EXCAVATING APPARATUS

[76] Inventor: Sherlock K. Pippins, 306 Rebecca Cir., Longview, Tex. 75601

[21] Appl. No.: 54,154

[22] Filed: Apr. 30, 1993

[51] Int. Cl.[5] ..... E02F 9/28

[52] U.S. Cl. ..... 37/453; 37/455; 37/456; 37/452

[58] Field of Search ..... 37/450, 452, 453, 455, 37/456, 457, 458, 459, 460, 446

[56] References Cited

U.S. PATENT DOCUMENTS

| | | | |
|---|---|---|---|
| 1,216,290 | 2/1917 | Dickson . | |
| 1,419,047 | 6/1922 | Hanks et al. . | |
| 3,839,805 | 10/1974 | Stepe . | |
| 3,974,579 | 8/1976 | Black et al. | 37/450 |
| 3,982,339 | 9/1976 | Nilsson . | |
| 4,326,348 | 4/1982 | Emrich | 37/453 |
| 4,335,532 | 6/1982 | Hahn et al. | 37/459 |
| 4,587,751 | 5/1986 | Sjogren et al. | 37/453 |
| 4,716,667 | 1/1988 | Martin | 37/453 |
| 5,081,774 | 1/1992 | Kuwano | 37/452 X |
| 5,088,214 | 2/1992 | Jones | 37/450 |
| 5,111,600 | 5/1992 | Lukavich et al. | 37/460 X |
| 5,172,501 | 12/1992 | Pippins | 37/455 X |

*Primary Examiner*—Randolph A. Reese
*Assistant Examiner*—J. Russell McBee
*Attorney, Agent, or Firm*—John M. Harrison

[57] ABSTRACT

A tooth assembly for mounting on the tooth horns of excavating or levelling apparatus buckets, shovels or alternative digging mechanisms. In a preferred embodiment the tooth assembly includes a wedge-shaped adapter for seating on a tooth horn, an insert removably seated in an insert cavity provided in each side of the adapter and a tooth point frontally engaging and bolted to the adapter by means of bolts threaded in the inserts, for engaging the material to be excavated. In another preferred embodiment top and bottom wear caps transversely slidably engage and bolt to the adapter adjacent to the tooth point for extending the life of the tooth assembly in the excavating or levelling operation.

20 Claims, 2 Drawing Sheets

TOOTH ASSEMBLY FOR EXCAVATING APPARATUS

BACKGROUND OF THE INVENTION

1. Field of the Invention

This invention relates to digging and levelling apparatus such as draglines, backhoes, front-end loaders and like equipment and more particularly, to a tooth assembly for mounting on the tooth horns of dragline buckets, backhoe shovels and front-end loader excavation or levelling equipment and engaging the material to be excavated or levelled. In a preferred embodiment, each tooth assembly is characterized by a wedge-shaped adapter which mounts directly on the tooth horn of the bucket, shovel or alternative digging or scraping mechanism of the operation equipment. A wedge-shaped tooth point is frontally seated on and bolted to a pair of inserts provided in cavities in the extending end of the adapter for engaging the material to be excavated or levelled. In a second preferred embodiment, a pair of wear caps transversely encapsulate and are bolted to that portion of the adapter which projects between the tooth point and the tooth horn, for extending the life of the tooth assembly during the excavating or levelling operation.

One of the problems which is inherent in excavation and levelling operations using heavy equipment such as draglines, backhoes, front-end loaders and similar equipment, is that of rapidly wearing the equipment teeth during the excavation or levelling operation. This problem is exacerbated under circumstances where the material to be excavated contains rocks, sand, concrete or other hard or abrasive particles which rapidly wear the bucket or shovel teeth and require expensive, periodic retrofits or replacement of the bucket or shovel. Accordingly, it is customary in the industry to provide removable excavating teeth which mount on adapters positioned on shaped, spaced tooth horns provided in the bucket, shovel or other material-moving apparatus, which teeth are typically attached to the tooth adapter using pins or other techniques, for removal due to wear. A problem associated with removing these teeth due to periodic wear is the difficulty of driving retaining pins or the like from registering apertures in the teeth and tooth adapters to remove and replace the teeth. Typically, this operation is effected using a large hammer, wherein the pins are manually driven from the teeth and tooth adapter, a procedure which requires considerable effort and is costly, due to the labor involved.

2. Description of the Prior Art

My U.S. Pat. No. 5,172,501, dated Dec. 22, 1992, details a tooth assembly for mounting on the tooth horns of excavating or levelling apparatus buckets, shovels or alternative digging mechanisms. The tooth assembly includes a wedge-shaped adapter shaped for seating on the tooth horn, a tooth point transversely slidably engaging and bolted or otherwise locked to the adapter for engagement of the material to be excavated and top and bottom wear caps, also transversely slidably engaging and bolted to the adaptor adjacent to the tooth point, for extending the life of the tooth assembly in the excavating or levelling operation. Other patents which are pertinent to the tooth assembly in the captioned application include U.S. Pat. No. 1,216,290, dated Feb. 20, 1917, to N. M. Dixon, which details an "Excavator Tooth". The excavator tooth includes a point having equal diversion arms equipped with inwardly-extending projections at their free ends and a base provided with a projection adapted to enter and fill the space between the arms and having edge recesses adapted to receive the projections and prevent relative longitudinal movement of the parts. The excavator tooth is reversible on the base for alternately presenting opposite edges of the tooth to wear. U.S. Pat. No. 1,419,047, dated Jun. 6, 1922, to G. R. Hanks, et al, includes a point-carrying element for a tooth member. The point-carrying element includes an upper and lower bearing surface transversely slotted and fitted with slide slots, with a reversible point having panels for slidable engagement with the transversely slotted portions and further including a side bar adapted to either of the side slots. U.S. Pat. No. 3,839,805, dated Oct. 8, 1974, to V. A. Stepe, details an "Open Side Ground-Engaging Tip" for mounting an adaptor on the cutting edge of an excavator bucket. The tip includes a wedge-shaped body which includes the wear part of the point and a rearwardly-extending strap at the top and bottom of the body. The straps diverge from the open side, generally U-shaped opening, for reception of the nose of the adaptor. Each strap has a key which extends laterally of the strap near the rear of the strap and the keys project normal to the straps and engage respective keyways located in the adaptor. U.S. Pat. No. 3,982,339, dated Sep. 28, 1976, to L. Nilsson, details a "Reversible Slide-On Digger Tooth With Easy Removal Arrangement". The tooth is designed to mount on a loading or excavating bucket and includes a support member adapted for connection to the edge of the bucket and a replaceable, wedge-shaped slide-on cap. The front portion of the support member is inclined with respect to the rear portion and the rear portion can be connected to the bucket in either of two positions, 180 degrees apart, so that the front portion and the slide-on cap can be disposed in either of two corresponding portions. U.S. Pat. No. 4,587,751, dated May 13, 1986, to Kay Sjogren, et al, details a "Wear Cap Style Excavating Tooth". The excavating tooth assembly includes a relatively elongated adapter equipped with a point at the digging end and at least one wear cap normally held in place by the point and further including lock means in the adapter to prevent dislodging of the wear cap. U.S. Pat. No. 4,716,667, dated Jan. 5, 1988, to Wesley E. Martin, details an "Excavating Tooth and Wear Cap Assembly". The assembly is designed such that the front pin which interconnects the replaceable point to the adapter nose is protected from undesirable deformation by interlocking, stabilizing lugs and grooves formed respectively, on the wear cap and adapter base portions of the assembly. Cooperation between these lugs and grooves prevents earth forces from driving the wear cap portion of the assembly forwardly along the adaptor base into the point and thereby causing the point to deform the connection pin. Field installation of a lower wear cap portion of the assembly is facilitated by cooperating support lugs on the wear cap and shoulders of the adapter, which, together with a pivotal interconnection between the adapter and wear cap, permit the lower wear cap to be hung from the adapter in a temporary support position until the point can be installed and interconnected to the wear cap to complete the assembly.

It is an object of this invention to provide a tooth assembly for mounting on buckets, shovels or other digging mechanisms in excavating or levelling apparatus, which tooth assembly is characterized by an adapter for removably mounting on each tooth horn of the excavating apparatus bucket, shovel or alternative excavating implement, a tooth point bolted to the tapered front end of the adapter by means of a shaped insert located in each of two cavities provided in each side of the adapter and, in one embodiment, a pair of wear caps bolted to opposite sides of the adapter between the tooth point and the tooth horn.

Another object of this invention is to provide a tooth assembly for mounting on each of the teeth of an excavating or levelling apparatus bucket, shovel or alternative digging implement, which tooth assembly includes a wedge-shaped, transversely-slotted adapter for mounting on the tooth horn of the excavating apparatus, a pair of shaped inserts provided in insert cavities located in opposite sides of the adapter and a wedge-shaped tooth point fitted with tooth point bolt openings for frontally mounting on the adaptor, receiving tooth point bolts threaded in the inserts and removably fitting the tooth point to the adapter. In a preferred embodiment top and bottom wear caps are provided, each fitted with transverse ribs adapted for engaging corresponding grooves or slots provided in the adapter, for transversely mounting the wear caps on opposite sides of the adapter rearwardly of the tooth point to facilitate extended wear of the tooth assembly during excavating or levelling operations.

A still further object of this invention is to provide a tooth assembly for mounting on the conventional tooth horn of individual teeth in the bucket or shovel of various excavating apparatus, which tooth assembly includes a transversely slotted, wedge-shaped adapter having a lock opening in the top for securing the adapter to the tooth horn, a pair of tapered insert cavities for removably receiving correspondingly tapered, internally-threaded inserts, a pair of L-shaped wear caps, each fitted with parallel ribs for engaging the corresponding transversely-oriented slots in the adapter, a pair of wear cap bolts for securing the wear caps to the adapter and a tooth point, fitted with a pair of bolt openings for receiving a pair of tooth point bolts which thread into the inserts for removably securing the tooth point to the adaptor forward of the wear caps.

SUMMARY OF THE INVENTION

These and other objects of the invention are provided in tooth assemblies for mounting on corresponding spaced tooth horns of excavating and levelling apparatus, each tooth assembly including the following elements: a wedge-shaped adapter which tapers from an adapter base at one end to a narrow nose ridge at the opposite end and provided with parallel top and bottom rib slots which extend transversely across the bottom and top wedge-shaped faces of the adapter; oppositely-disposed, tapered insert cavities provided in opposite sides of the adapter; internally-threaded, tapered inserts designed to removably seat in the insert cavities; a tapered tooth point fitted with oppositely-disposed tooth point bolt openings in the sides thereof, which tooth point bolt openings align with the inserts when the tooth point is frontally positioned on the adapter; and tooth point bolts for extending through the tooth point bolt openings, threading into the inserts and securing the tooth point on the adapter. In a preferred embodiment, a pair of L-shaped top and bottom wear caps are provided, each having cap plate ribs for engaging the parallel top and bottom rib slots, respectively, in the adapter and seating the wear caps on the top and bottom of the adapter from opposite directions. A wear cap bolt extends through each of the wear caps, respectively, and is threaded into the adapter for removably securing the wear caps on the adapter.

BRIEF DESCRIPTION OF THE DRAWINGS

The invention will be better understood by reference to the accompanying drawings, wherein.

DESCRIPTION OF THE PREFERRED EMBODIMENTS

Figures 1, 2:
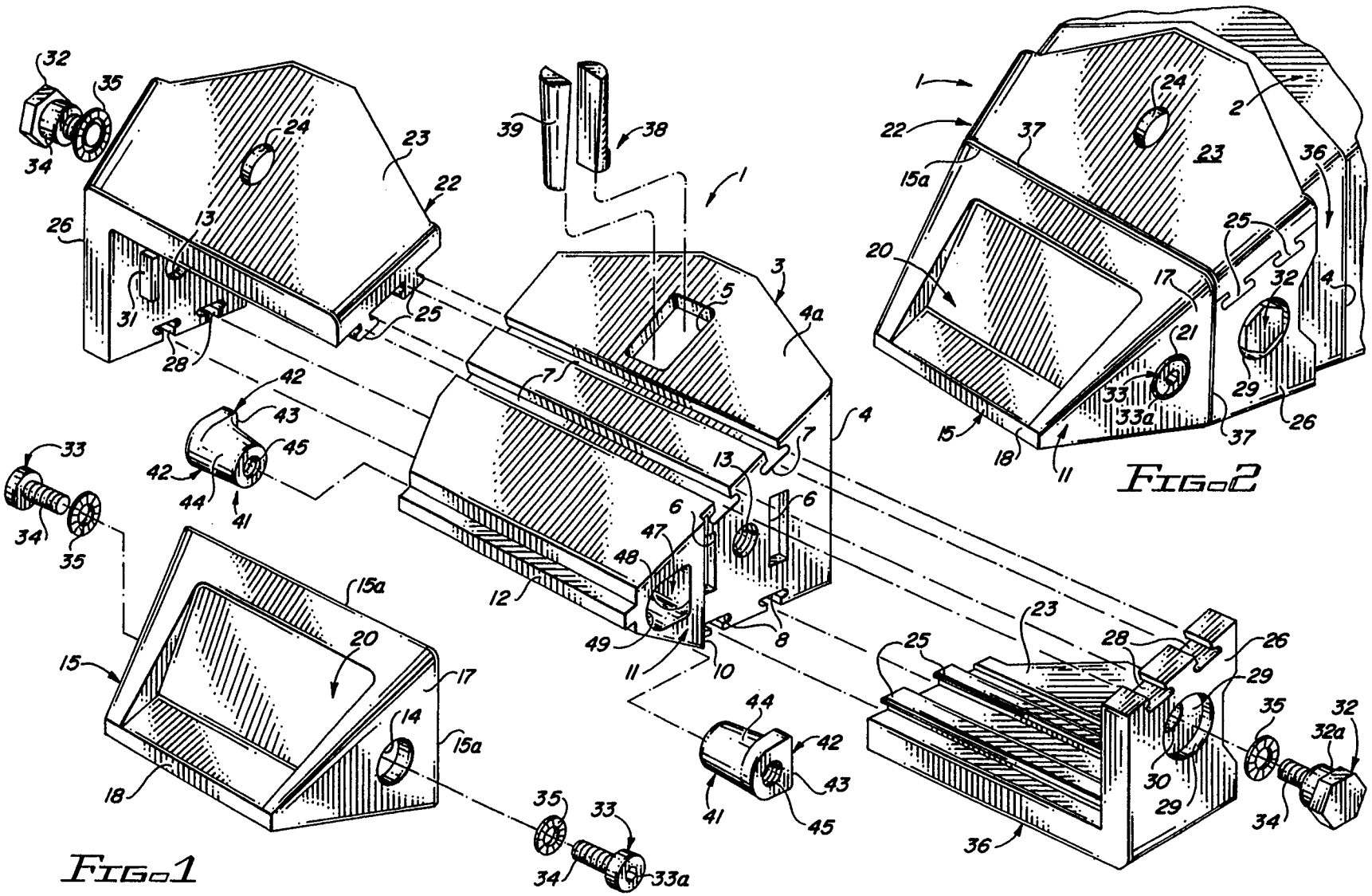
FIG. 1 is an exploded view of a preferred embodiment of the tooth assembly of this invention mounted on a conventional tooth horn of a bucket or shovel of an excavating apparatus.
FIG. 2 is a perspective view of the tooth assembly illustrated in FIG. 1 assembled on the conventional tooth horn.
Figure 4:
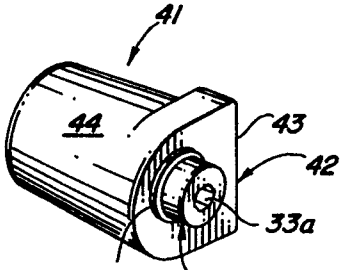
FIG. 4 is a perspective view of an insert element of the tooth assembly illustrated in FIGS. 1–3.

Referring to the drawings and to FIGS. 1 and 2 in particular, the tooth assembly of this invention is generally illustrated by reference numeral 1 and is mounted on a conventional tooth horn 2 of the bucket or shovel of a conventional excavator (not illustrated). The tooth assembly 1 includes a wedge-shaped adapter 3, fitted with a removable tooth point 15, which has a contact edge 18 and is mounted on the adapter 3 by means of a pair of tooth point bolts 33, each extending through a tooth point bolt opening 14 in the tooth point side wall 17 of the tooth point 15 and threaded in an internally-threaded insert 41, seated in opposite sides of the adapter 3. In a preferred embodiment, the tooth assembly 1 further includes a transversely-mounted top wear cap 22 and bottom wear cap 36, both of which are also bolted to the adapter 3 by means of side plate bolts 32, respectively. In a most preferred embodiment of the invention the adapter 3 includes a wedge-shaped adapter base 4 which tapers from a base plate **4*a* to a nose ridge 12, terminating the adapter nose 11. A base plate lock opening 5 is provided in the base plate 4*a* of the adapter base 4 for receiving a spool 38 and a companion wedge 39 and mounting the adapter 3 on the tooth horn 2 in conventional fashion. A pair of transverse, vertically-oriented, spaced stabilizing slots 6 are provided in the sides of the adapter base 4, for purposes which will be hereinafter further described. Spaced, parallel top rib slots 7 are also provided transversely in the top tapered face of the base plate 4*a* of the adapter base 4 and in a most preferred embodiment, the top rib slots 7 are T-shaped, as illustrated in the drawings. Similarly, a pair of spaced, T-shaped bottom rib slots 8 are provided in the bottom tapered surface or face of the adapter base plate 4*a* in the same relative position as the top rib slots 7. It is understood that the top rib slots 7 and bottom rib slots 8** may alternatively be shaped in a "dove-tail", or alternative locking configuration, according to the knowledge of those skilled in the art.

Figure 3:
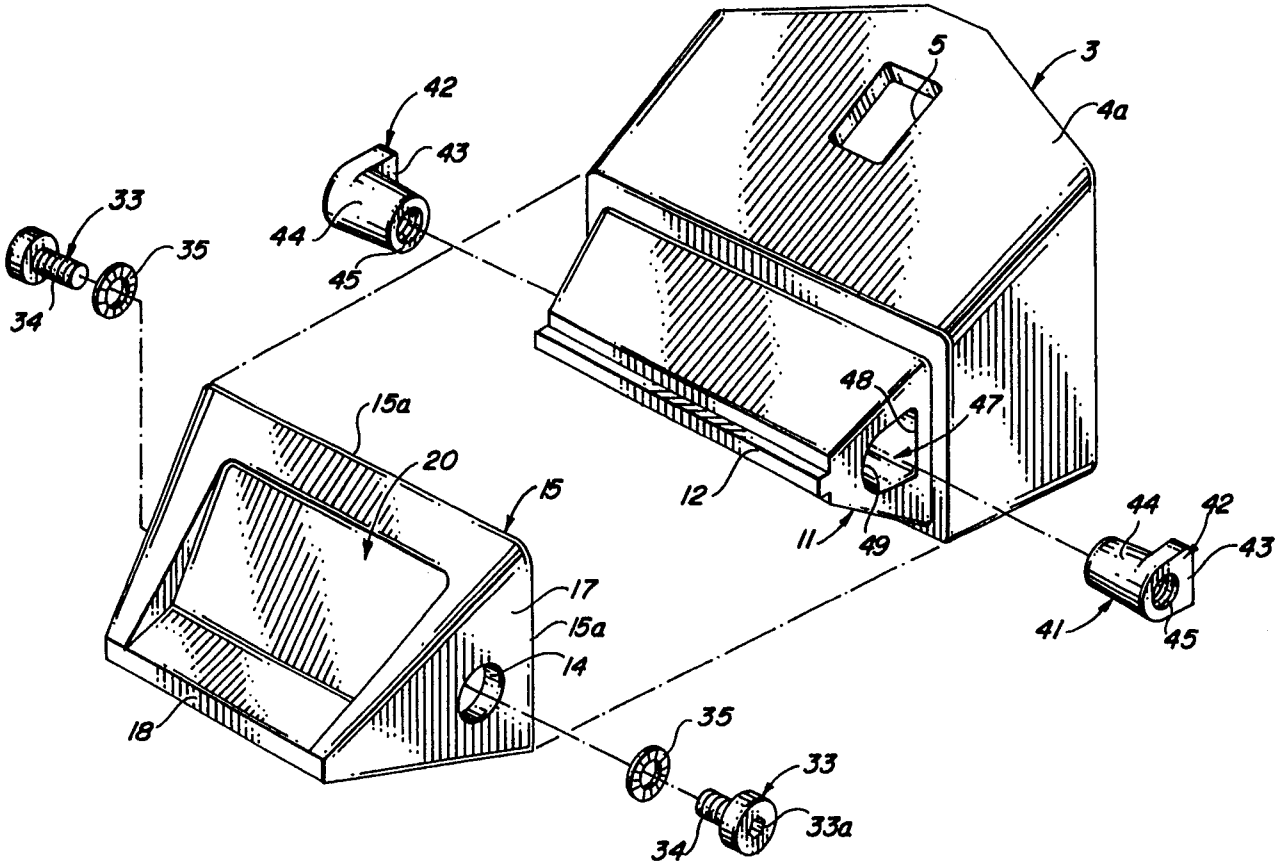
FIG. 3 is an exploded view of the adapter and tooth point elements of the tooth assembly illustrated in FIGS. 1 and 2 in a second preferred embodiment.

As further illustrated in FIG. 1, the top wear cap 22 and bottom wear cap 36 are designed to slidably mount transversely on the adapter base 4 of the adapter 3. The L-shaped top wear cap 22 and bottom wear cap 36 are each characterized by identical cap plates 23 and corresponding side plates 26 and are therefore interchangeable. The cap plate 23 of the top wear cap 22 further includes a cap plate opening 24, which registers with the base plate lock opening 5 located in the adapter 3, to provide access to the spool 38 and wedge 39 for readily tensioning the wedge 39 if necessary, as illustrated in FIG. 1. A pair of spaced, T-shaped cap plate ribs 25 are transversely located in the bottom surface of the cap plate 23 of the top wear cap 22 and are designed to register with the spaced top rib slots 7 provided in the adapter 3. Similarly, additional cap plate ribs 25 are provided in spaced relationship in the top surface of the cap plate 23 of the bottom wear cap 36 for registering with corresponding spaced parallel bottom rib slots 8, located in the bottom face of the adapter 3, also as illustrated in FIG. 1. A side plate bolt opening 30 is provided in each of the side plates 26 of the top wear cap 22 and the bottom wear cap 36 for receiving the side plate bolts 32, respectively, in order to lock the top wear cap 22 on the top and one side of the adapter 3 and the bottom wear cap 36 on the bottom and opposite side of the adapter 3, as illustrated in FIG. 2. As further illustrated in FIGS. 1 and 2 of the drawings, the adapter 3 is fitted with an adapter recess 10 on one side to facilitate recessing of the side plate 26 of the bottom wear cap 36 and extension of the corresponding cap plate ribs 25, located in the bottom surface of the cap plate 23 of the top wear cap 22, into the corresponding side plate slots 28, provided in the extending end of the side plate 26 of the bottom wear cap 36. Similarly, the projecting cap plate ribs 25, located in the cap plate 23 of the bottom wear cap 36, project in registration with the corresponding side plate slots 28, located in the extending end of the side plate 26 of the top wear cap 22 when the top wear cap 22 and bottom wear cap 36 are assembled and interlocked on the adapter 3, as illustrated in FIG. 3. A side plate recess 29 is provided in the side plate 26 of each of the top wear cap 22 and bottom wear cap 36 and surrounds a corresponding side plate bolt opening 30, to accommodate the head of the side plate bolts 32 in countersunk, recessed relationship. Furthermore, spaced side plate lugs 31 are provided in the side plate 26 of the top wear cap 22 and bottom wear cap 36 for registering with the corresponding spaced stabilizing slots 6, located in the sides of the adapter 3, respectively. Accordingly, it will be appreciated by those skilled in the art that when the top wear cap 22 and bottom wear cap 36 are mounted on the adapter 3 from opposite sides, with the respective cap plate ribs 25 engaging corresponding top rib slots 7 and bottom rib slots 8 located in the bevelled top and bottom faces of the adapter base **4*a*, respectively, the top wear cap 22 and bottom wear cap 36 are interlocked as illustrated in FIGS. 1 and 2. Furthermore, insertion of the side plate bolts 32 through the respective side plate bolt openings 30 in the side plates 26 of the top wear cap 22 and bottom wear cap 36, respectively, and threading of the side plate bolts 32 in the respective threaded openings 13 located in the sides of the adapter 3, locks the top wear cap 22 and bottom wear cap 36 securely on the adapter 3, with the side plate lugs 31 engaging the corresponding stabilizing slots 6 located in the adapter 3. The top wear cap 22 and bottom wear cap 36 are thus prevented from disengaging the adapter 3 without removing the side plate bolts 32. Moreover, the heads of the side plate bolts 32 are securely recessed inside the respective side plate recesses 29, provided in the side plates 26, to minimize the possibility of shearing the side plates bolts 32 from the tooth assembly 1**.

In another preferred embodiment of the invention each of the side plate bolts 32 is provided with a bolt shoulder **32*a* located beneath the head thereof and includes bolt threads 34. A lock washer 35, illustrated in FIG. 1, may be provided on the threaded shank of the side plate bolts 32 for securing each of the side plate bolts 32 in the adapter 3, as illustrated in FIG. 2. However, in a most preferred embodiment of the invention the heads of the respective side plate bolts 32 are spaced from the recess shoulder 29*a* of each side plate recess 29. This spacing facilitates limited movement of the top wear cap 22 and bottom wear cap 36 with respect to the adapter 3 as described in my U.S. Pat. No. 5,172,501 and serves as a stress-relieving function to minimize damage to the tooth assembly 1 by operation of the excavation or levelling equipment upon which the tooth assembly 1** is mounted.

Figure 5:
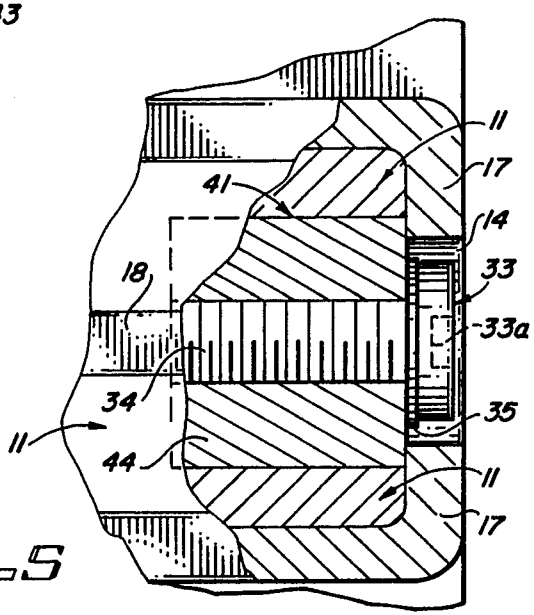
FIG. 5 is a partial sectional view of the adapter, tooth point and insert elements of the tooth assembly in assembled configuration as illustrated in FIG. 2.

Referring now to FIGS. 1 and 3–5 of the drawings, the tooth point 15 is removably attached to the adapter 3 by means of two tapered inserts 41, each inserted in a correspondingly-shaped insert cavity 47, provided in the wedge-shaped tooth point side walls 17 of the adapter 3. Each insert 41 includes an internally-threaded insert bore 45, extending through a tapered, rounded insert body 44 which terminates in an insert shoulder 42, having a straight shoulder edge 43. The respective oppositely-disposed insert cavities 47 are tapered and shaped to define a cavity shoulder 48, which engages the insert shoulder 42, and a body curvature 49, which engages the insert body 44. Accordingly, the insert cavities 47 removably receive the inserts 41 and prevent the inserts 41 from rotating when pressure is applied to the tooth point bolts 33, which secure the tooth point 15 on the adapter 3. This pressure is applied by means of an allen wrench (not illustrated) inserted in the allen wrench receptacle **33*a* provided in the head of the tooth point bolt 33. Accordingly, referring again to FIGS. 1 and 2, the tooth point 15 is designed to mount frontally on the adapter nose 11 of the adapter 3 by matching the tooth point bolt openings 14, located in the opposite tooth point side walls 17 of the tooth point 15, with the corresponding insert bores 45, provided in the inserts 41. Each tooth point bolt 33 is then registered with a corresponding tooth point bolt opening 14 and the threaded shank of each tooth point bolt 33 is inserted into the corresponding internally-threaded insert bore 45 located in the insert 41, to removably secure the tooth point 15 on the adapter 3. When the tooth point 15 is so inserted on the adapter 3, the tooth point edge 15*a* is located in close proximity to the corresponding edges of the cap plates 23 and side plates 26 of the top wear cap 22 and bottom wear cap 36, respectively, as illustrated in FIG. 2. However, a working gap 37 is maintained between the tooth point edge 15*a* of the tooth point 15 and the front edges of the top wear cap 22 and bottom wear cap 36, respectively, to facilitate movement of the tooth point 15 and top wear cap 22, as well as the bottom wear cap 36, with respect to the adapter 3. In a most preferred embodiment of the invention, like the top wear cap 22 and the bottom wear cap 36, the tooth point 15 is secured to the adapter 3 using a tooth point bolt 33 which is fitted with a lock washer 35. As illustrated in FIG. 5, since the diameter of the tooth point bolt opening 14 is smaller than the external dimensions of the inserts 41 at the insert shoulder 42, the inserts 41 cannot exit the respective insert cavities 47 through the tooth point bolt openings 14. However, the inserts 41 can be easily removed from the insert cavities 47 when the adapter nose 11 is removed from the adapter 3. Accordingly, the adapter nose 11 is afforded a range of movement on the adapter 3 due to the space between the heads of the tooth point bolts 33 and the periphery of the tooth point bolt openings 14, as well as the working gap 37**, to relieve digging stresses.

It will be appreciated from a consideration of the drawings that the tooth assembly of this invention exhibits multiple favorable structural characteristics not found in conventional assemblies. The interlocking relationship between the top wear cap 22 and bottom wear cap 36, along with the transverse, slidable mounting of these structural members and the removable mounting of the tooth point 15 on the adapter 3, facilitate an extremely strong, versatile wear-resistant assembly. Furthermore, recessing of the respective side plate bolts 32 and tooth point bolts 33, as well as the side plates 26 of the top wear cap 22 and the bottom wear cap 36 provided in opposite sides of the adapter 3, facilitate excavation and levelling of all types of material without fear of shearing the respective side plate bolts 32 and tooth point bolts 33. Moreover, use and replacement of the top wear cap 22, bottom wear cap 36 and tooth point 15 independently or in concert, is quickly and easily facilitated in an optimum manner by simply removing the side plate bolts 32 and tooth point bolts 33, sliding the top wear cap 22, bottom wear cap 36 and tooth point 15 from the adapter 3 and replacing these members by reversing this procedure. Shock and impact resistance of the tooth assembly 1 is facilitated by mounting the top wear cap 22 and bottom wear cap 36 and tooth point 15 in a non-rigid, but secure relationship on the adapter 3 to facilitate a selected minimum movement of the top wear cap 22, bottom wear cap 36 and tooth point 15 with respect to the adapter 3 during operation. Use of the inserts 41 to mount the tooth point 15 on the adapter 3 facilitates quick and easy removal and replacement of the tooth point 15 without risk of cross-threading the tooth point bolts 33 directly into tapped holes provided in the adapter 3. Such tapped holes are subject to various types of damage and the inserts 41 are capable of easy replacement to avoid this problem. A tooth assembly 1 is mounted on each tooth horn 2 of a conventional bucket or shovel of a conventional excavating apparatus in conventional manner, utilizing the spool 38 and wedge 39, according to the knowledge of those skilled in the art. It will be appreciated that alternative means for mounting the tooth assembly 1 to the tooth horn of such equipment may also be implemented without departing from the spirit and scope of the invention as embodied herein.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A tooth assembly for mounting on a tooth horn of an excavating apparatus, comprising wedge-shaped adapter means adapted for mounting on the tooth horn; insert means removably provided in said adapter means in transverse relationship with respect to the longitudinal axis of said adapter means; point means having a pair of bolt openings and adapted for engaging said adapter means with said bolt openings substantially aligned with said insert means, respectively; point bolt means for extending through said bolt openings, threadably engaging said insert means and bolting said point means to said adapter means; at least one pair of slots provided in said adapter means; a pair of wear cap means having at least one wear cap rib adapted for engaging said slots and removably mounting said wear cap means on said adapter means adjacent to said point means; and wear cap bolt means adapted for bolting said wear cap means to said adapter means, whereby said point means and said wear cap means may be removed from said adapter means responsive to removal of said point bolt means and said wear cap bolt means, respectively.

2. The tooth assembly of claim 1 comprising at least one stabilizing slot provided in each side of said adapter means and at least one lug provided in each of said wear cap means for engaging said stabilizing slot, respectively, when said wear cap means are positioned on said adapter means.

3. The tooth assembly of claim 1 comprising a lock opening provided in said adapter means, a cap plate opening provided in the top one of said wear cap means, said cap plate opening positioned in registration with said lock opening and lock means adapted for insertion in said lock opening and engaging the tooth horn, for locking said adapter means on the tooth horn.

4. The tooth assembly of claim 1 comprising:

(a) at least one stabilizing slot provided in each side of said adapter means and at least one lug provided on each of said wear cap means for engaging said stabilizing slot, respectively, when said wear cap means are positioned on said adapter means; and (b) a lock opening provided in said adapter means, a cap plate opening provided in the top one of said wear cap means, said cap plate opening positioned in registration with said lock opening and lock means adapted for insertion in said lock opening and engaging the tooth horn, for locking said adapter means on the tooth horn.

5. The tooth assembly of claim 1 wherein said at least one pair of slots comprises a pair of inverted T-slots and said at least one wear cap rib each further comprises a pair of T-shaped members for slidably engaging said inverted T-slots, respectively.

6. The tooth assembly of claim 5 comprising:

(a) at least one stabilizing slot provided in each side of said adapter means and at least one lug provided on each of said wear cap means for engaging said stabilizing slot, respectively, when said wear cap means are positioned on said adapter means; and (b) a lock opening provided in said adapter means, a cap plate opening provided in the top one of said wear cap means, said cap plate opening positioned in registration with said lock opening and lock means adapted for insertion in said lock opening and engaging the tooth horn, for locking said adapter means on the tooth horn.

7. The tooth assembly of claim 1 wherein said insert means comprises a tapered, rounded body portion, a shoulder terminating one end of said body portion and an internally-threaded bore provided in said body portion for threadably receiving said point bolt means and comprising a wear cap recess opening provided in each of said wear cap means for accessing said wear cap bolt means and a pair of wear cap threaded apertures provided in opposite sides of said adapter means for threadably receiving said wear cap bolt means, respectively.

8. The tooth assembly of claim 7 comprising at least one stabilizing slot provided in each side of said adapter means and at least one lug provided on each of said wear cap means for engaging said stabilizing slot, respectively, when said wear cap means are positioned on said adapter means.

9. The tooth assembly of claim 8 comprising a lock opening provided in said adapter means, a cap plate opening provided in the top one of said wear cap means, said cap plate opening positioned in registration with said lock opening and lock means adapted for insertion in said lock opening and engaging the tooth horn, for locking said adapter means on the tooth horn.

10. The tooth assembly of claim 9 wherein said at least one pair of slots comprises a pair of inverted T-slots and said at least one wear cap rib each further comprises a pair of T-shaped members for slidably engaging said inverted T-slots, respectively.

11. A tooth assembly for mounting on the tooth horn of a bucket or shovel in an excavating apparatus, comprising a wedge-shaped adapter having top and bottom faces and a longitudinal taper extending from a maximum height at a base end to a narrow nose end and spaced, substantially parallel wear cap slots located in said top and bottom faces of said adapter, respectively, in transverse relationship with respect to said longitudinal taper; a pair of insert cavities shaped in opposite sides of said adapter and a pair of threaded wear cap apertures provided in opposite sides of said adapter and spaced from said insert cavities; a pair of inserts having internally-threaded insert bores, removably inserted in said insert cavities; a wedge-shaped tooth point having a pair of bolt openings for registration with said inserts when said tooth point is inserted on said nose end of said adapter; a pair of point bolts for extending through said bolt openings and threadably engaging said threaded insert bores of said inserts and seating against said inserts, respectively, and removably securing said tooth point on said nose end of said adapter; a pair of L-shaped wear caps, each having a wear cap recess opening provided with a recess shoulder and a pair of spaced, parallel, transverse wear cap ribs adapted for slidably and transversely engaging said wear cap slots, respectively, and removably mounting said wear caps on said adapter adjacent to said tooth point; and a pair of wear cap bolts, each having a bolt shoulder adapted for seating in said wear cap recess openings against said adapter, respectively, and threadably engaging said threaded wear cap apertures, respectively, and removably securing said wear caps on said adapter, with the heads of said wear cap bolts spaced from said recess shoulder, whereby said tooth point and said wear caps may move with respect to said adapter responsive to operation of said excavating apparatus.

12. The tooth assembly of claim 11 comprising at least one stabilizing slot provided in each side of said adapter and at least one lug provided on each of said wear caps for engaging said stabilizing slot, respectively, when said wear caps are positioned on said adapter.

13. The tooth assembly of claim 11 further comprising a lock opening provided in said adapter, a cap plate opening provided in the top one of said wear caps, said cap plate opening positioned in registration with said lock opening and lock means adapted for insertion in said lock opening and engaging the tooth horn, for locking said adapter on the tooth horn.

14. The tooth assembly of claim 11 further comprising:

(a) at least one stabilizing slot provided in each side of said adapter and at least one lug provided on each of said wear caps for engaging said stabilizing slot, respectively, when said wear caps are positioned on said adapter; and (b) a lock opening provided in said adapter, a cap plate opening provided in the top one of said wear caps, said cap plate opening positioned in registration with said lock opening and lock means adapted for insertion in said lock opening and engaging the tooth horn, for locking said adapter on the tooth horn.

15. The tooth assembly of claim 11 wherein said wear cap slots further comprise T-shaped slots and said wear cap ribs further comprise T-shaped members for slidably engaging said T-shaped slots, respectively.

16. The tooth assembly of claim 15 further comprising:

(a) at least one stabilizing slot provided in each side of said adapter and at least one lug provided on each of said wear caps for engaging said stabilizing slot, respectively, when said wear caps are positioned on said adapter; and (b) a lock opening provided in said adapter, a cap plate opening provided in the top one of said wear plates, said cap plate opening positioned in registration with said lock opening and lock means adapted for insertion in said lock opening and engaging the tooth horn, for locking said adapter on the tooth horn.

17. A tooth assembly for mounting on the tooth horn of a digging implement in an excavating apparatus, comprising a wedge-shaped adapter having top and bottom faces and adapted for mounting on the tooth horn; a pair of insert cavities provided in opposite sides of said adapter, each of said insert cavities having a cavity shoulder defined in a cavity body curvature; a pair of inserts removably located in said insert cavities, respectively, each of said inserts having an insert shoulder for engaging said cavity shoulder, an insert body curvature for engaging said cavity body curvature and an internally-threaded insert aperture; a tooth point shaped for removably mounting on said adapter and a pair of bolt openings provided in opposite sides of said tooth point; and a pair of tooth point bolts for extension through said bolt openings and threadably engaging said insert aperture, respectively, and bolting said tooth point to said adapter, whereby said tooth point may be removed from said adapter responsive to removal of said tooth point bolts.

18. The tooth assembly of claim 17 comprising a pair of slots provided in said top and bottom faces of said adapter in spaced, substantially parallel relationship with respect to each other; a pair of L-shaped wear caps having wear cap ribs for engaging said slots from opposite directions, respectively, and removably mounting said wear caps on said adapter spaced from said tooth point; at least one stabilizing slot provided in each side of said adapter; and at least one lug provided on each of said wear caps for engaging said stabilizing slot, respectively, when said wear caps are positioned on said adapter.

19. The tooth assembly of claim 18 further comprising a lock opening provided in said adapter, a cap plate opening provided in the top one of said wear caps, said cap plate opening positioned in registration with said lock opening and lock means adapted for insertion in said lock opening and engaging the tooth horn, for locking said adapter on the tooth horn.

20. The tooth assembly of claim 19 wherein said slots further comprise T-shaped slots and said wear cap ribs further comprise T-shaped members for slidably engaging said T-shaped slots, respectively.

* * * * *